US009605230B2

(12) United States Patent
Bouvier et al.

(10) Patent No.: US 9,605,230 B2
(45) Date of Patent: Mar. 28, 2017

(54) USE OF ZEOLITES FOR STABILIZING OILS

(75) Inventors: Ludivine Bouvier, Orthez (FR); Beatrice Boussand, Sainte Foy les Lyons (FR)

(73) Assignee: CECA S.A., La Garenne Colombes (FR)

( * ) Notice: Subject to any disclaimer, the term of this patent is extended or adjusted under 35 U.S.C. 154(b) by 0 days.

(21) Appl. No.: 13/441,061

(22) Filed: Apr. 6, 2012

(65) Prior Publication Data

US 2012/0256119 A1 Oct. 11, 2012

Related U.S. Application Data

(60) Provisional application No. 61/473,436, filed on Apr. 8, 2011.

(30) Foreign Application Priority Data

Apr. 8, 2011 (FR) ..... 11 53091

(51) Int. Cl.
*C10M 125/26* (2006.01)
*C10M 169/04* (2006.01)

(52) U.S. Cl.
CPC ..... *C10M 125/26* (2013.01); *C10M 169/04* (2013.01); *C10M 2201/103* (2013.01); *C10M 2207/2835* (2013.01); *C10M 2209/043* (2013.01); *C10M 2209/1033* (2013.01); *C10M 2211/022* (2013.01); *C10N 2230/08* (2013.01); *C10N 2240/201* (2013.01); *C10N 2240/30* (2013.01); *C10N 2240/401* (2013.01)

(58) Field of Classification Search
CPC ..... C09K 5/00; C09K 5/044; C09K 5/045; C09K 2205/122; C10M 169/06; C10M 169/02; C01B 39/14; C01B 39/22; C01B 39/24; C01B 39/00; C10B 39/20
USPC ..... 252/68, 69; 508/163; 423/700, 718
See application file for complete search history.

(56) References Cited

U.S. PATENT DOCUMENTS

| | | | | |
|---|---|---|---|---|
| 2,583,812 | A | 1/1952 | Briggs et al. | |
| 2,882,243 | A | 4/1959 | Milton | |
| 3,625,866 | A * | 12/1971 | Conde | B01J 20/183 502/503 |
| 4,013,566 | A | 3/1977 | Taylor | |
| 4,851,144 | A | 7/1989 | McGraw et al. | |
| 5,514,633 | A * | 5/1996 | Noguchi | C07C 17/38 502/64 |
| 5,879,581 | A * | 3/1999 | Ushimaru | C09K 5/045 252/67 |
| 6,044,660 | A * | 4/2000 | Numoto et al. | 62/468 |
| 6,168,720 | B1 * | 1/2001 | Lavin | B01D 53/261 210/660 |
| 6,840,058 | B2 * | 1/2005 | Funakura | B01J 20/041 62/474 |
| 7,000,426 | B2 * | 2/2006 | Jeuch | F25B 17/08 252/69 |
| 7,422,993 | B2 * | 9/2008 | Takewaki | B01D 53/28 502/61 |
| 7,608,134 | B1 * | 10/2009 | Plee | B01D 53/04 95/106 |
| 2001/0014707 | A1 | 8/2001 | Thomas et al. | |
| 2003/0171205 | A1 * | 9/2003 | Jaussaud | B01D 53/02 502/68 |
| 2005/0119112 | A1 * | 6/2005 | Pfenninger | B01D 53/02 502/64 |
| 2008/0116417 | A1 * | 5/2008 | Samuels et al. | 252/68 |
| 2009/0283712 | A1 | 11/2009 | Zyhowski et al. | |
| 2010/0081851 | A1 * | 4/2010 | Cohen | B01D 53/02 568/917 |
| 2012/0117990 | A1 * | 5/2012 | Rached et al. | 62/115 |
| 2012/0256119 | A1 * | 10/2012 | Bouvier et al. | 252/68 |
| 2012/0256120 | A1 * | 10/2012 | Bouvier et al. | 252/68 |

FOREIGN PATENT DOCUMENTS

| | | | |
|---|---|---|---|
| EP | 1566600 | | 8/2005 |
| FR | 1257034 | | 3/1961 |
| FR | 2948678 | A1 * | 2/2011 |
| JP | H04-110388 | | 4/1992 |
| JP | 2001049275 | A * | 2/2001 |
| JP | 2004060952 | A * | 2/2004 |
| WO | 2004/037913 | | 5/2004 |
| WO | 2007/144632 | | 12/2007 |
| WO | 2008/027511 | | 3/2008 |
| WO | 2008/027512 | | 3/2008 |
| WO | 2008/027513 | | 3/2008 |
| WO | 2008/027514 | | 3/2008 |
| WO | 2008/027515 | | 3/2008 |
| WO | 2008/027516 | | 3/2008 |
| WO | 2008/027596 | | 3/2008 |
| WO | 2008/042066 | | 4/2008 |
| WO | 2010/063975 | | 6/2010 |
| WO | 2010/075046 | | 7/2010 |
| WO | WO 2012143651 | A1 * | 10/2012 |

OTHER PUBLICATIONS

Donald W. Breck, "Zeolite Molecular Sieves", published by John Wiley and Sons (1974), pp. 83-107.

* cited by examiner

*Primary Examiner* — Douglas McGinty
(74) *Attorney, Agent, or Firm* — Smith, Gambrell & Russell, LLP

(57) ABSTRACT

The present invention relates to the use of zeolites or of agglomerates based on zeolites in order to improve the thermal stability of oils and the invention is targeted in particular at the use of these zeolitic compounds for stabilizing the oils or the formulations based on oils participating in the composition of refrigerants.

28 Claims, No Drawings

USE OF ZEOLITES FOR STABILIZING OILS

This application claims the benefit of U.S. Patent Application Ser. No. 61/473,436, filed 8 Apr. 2011, and French Patent Application Serial No. 11.53091, filed 8 Apr. 2011, both of which are herein incorporated by reference in their entirety.

The present invention relates to the use of zeolites or zeolite-based agglomerates in order to improve the thermal stability of oils of any type. In particular, the invention is targeted at the use of these zeolitic compounds for stabilizing oils or oil-based formulations which are participants in the composition of refrigerants.

Oils are used today in a great many industrial fields, whether for lubricating, heating or refrigeration applications, and generally transportation or heat exchange applications, and others.

During their uses as refrigeration fluids, these oils are subjected to more or less large variations in temperature, and more particularly to a number cycles of more or less important variations in temperature. These numerous variations in temperature lead to the deterioration of said oils over time and may become unsuitable for the use for which they are intended, resulting in failure of the systems for which they are employed to operate properly.

In order to overcome this disadvantage, it is known to add various additives to these oils which make it possible to substantially improve their thermal stability. However, these additives are only moderately effective and the complete or partial replacement of these oils remains necessary at relatively frequent intervals. This results in the shutdown of the systems which use them and in ever greater amounts of oils to discharge or to be treated and/or recycled.

It is therefore necessary to find novel means which make it possible to further improve the thermal stability of the oils, in order to extend their lifetime and thus to carry out their partial or complete replacement as infrequently as possible, in order to limit even more the shutdowns of the systems in which they are used and to limit the amounts of oils to be discharged to the environment or to be treated or recycled.

The Applicant Company has now discovered that the presence of zeolites in the oils which are subjected to various large variations in temperature during their uses, makes it possible to significantly improve the thermal stability of said oils, in other words to significantly improve their life time, and therefore replacing these oils with a significantly lesser frequency.

Thus, the present invention relates first of all to the use of at least one zeolitic adsorbent, in the form of a powder formed of zeolite(s), of agglomerate(s) formed of zeolite(s), or other forms, for improving the thermal stability or also for reducing the thermal decomposition of oils subjected to variations in temperature.

The zeolitic adsorbents, or more simply the zeolites, which can be used in the context of the present invention can be of any type known to a person skilled in the art and in particular zeolites of zeolite A type, zeolites of faujasite type, that is to say zeolites X, MSX and LSX (for "Low Silica X"), and zeolites Y. It is understood that these different zeolites can be used alone or as mixtures of two or more of them.

Zeolites, or also molecular sieves, are chemical compounds widely used today in industry as adsorbent agents, in particular for drying gases or liquids. Zeolites are typically crystalline and porous compounds based on aluminosilicates which have a three-dimensional crystalline structure composed of an assembly of $SiO_4$ and $AlO_4$ tetrahedra connected to one another by virtue of the sharing of one or more oxygen atoms. These compounds thus form crystal lattices comprising pores of nanometric size.

These edifices generally comprise cations in order to render the system electrically neutral, these cations generally being cations comprising sodium, potassium or calcium but also barium, rare earth elements or also mixtures of two or more of these cations in all proportions.

In general, the zeolites used are synthetic zeolites obtained in the powder form on conclusion of a process for the nucleation and crystallization of aluminosilicate gels. Natural zeolites, such as, for example, zeolites of clinoptilolite, mordenite or chabazite type, the main uses of which are generally purification or dehydration operations, can also be used.

According to a preferred embodiment of the present invention, the zeolite(s) used comprise zeolites of zeolite A type, zeolites of faujasite type, that is to say zeolites X, MSX and LSX, and zeolites Y.

Zeolites correspond to the following general formula:

$$M_{x/n}[(AlO_2)_x(SiO_2)_y].wH_2O$$

in which:

M represents one or more cations with a total valency of n, w represents the number of water molecules, the ratio (y/x) is between 1 and 5, depending on the structures of the zeolites, and the sum (x+y) represents the number of tetrahedra per unit cell.

The structure and the properties of zeolite A are well known and extensively described in the literature, in particular in the work by Donald W. Breck, "Zeolite Molecular Sieves", published by John Wiley and Sons (1974), pp. 83 et seq., and by the patents of Milton (U.S. Pat. No. 2,882,243) and Barrer (FR 1 257 034).

The Si/Al ratio in the zeolites A is always approximately 1. The presence of sodium cations makes it possible to provide the electrical neutrality of the structure.

The modification in the nature of the cations by exchange of all or part can be accompanied by a variation in the size of the pores or by a modification in the selectivity by creation of specific interactions with the adsorbed molecules and can thus change the adsorption properties.

Thus, for zeolite A, which, in the sodium form after synthesis, exhibits a pore opening of 4 Å (often referred to as "zeolite 4A"), it is possible to carry out various exchanges of cations in order to confer the desired properties on it. Frequently, the cations concerned are alkali metal or alkaline earth metal cations, such as lithium ($Li^+$), potassium ($K^+$), caesium ($Cs^+$), magnesium ($Mg^{2+}$), calcium ($Ca^{2+}$), strontium ($Sr^{2+}$), barium ($Ba^{2+}$) or cerium ($Ce^{3+}$), or cations of other elements, such as rare earth elements or metals, for example lanthanum ($La^{2+}/La^{3+}$), silver ($Ag^+$), copper ($Cu^{2+}$), nickel ($Ni^{2+}$), zinc ($Zn^{2+}$), iron ($Fe^{2+}$, $Fe^{3+}$), chromium ($Cr^{2+}$ to $Cr^{6+}$) and others.

Thus, depending on the type of cation exchange carried out, the zeolite A can, for example, be converted either:

into the calcium form by exchange with a calcium salt in aqueous solution, in order to obtain a zeolite having pores with an effective opening of 5 Å (often referred to as "zeolite 5A"), into the potassium form by exchange with a potassium salt in aqueous solution, and a zeolite is obtained having pores with an effective opening of 3 Å (often referred to as "zeolite 3A"), into different forms by mixing aqueous solutions of lithium, calcium or potassium salts, for example.

The term "zeolite 4A" is understood here to mean a zeolite of type A, essentially all the exchangeable cationic sites of which are occupied by sodium $Na^+$ cations (sodium form after synthesis).

The term "zeolite 5A" is understood here to mean a zeolite of type A, with from 40% to 100% of the exchangeable cationic sites of which (reported as equivalents) are occupied by $Ca^{2+}$ ions, and 0% to 5% are occupied by alkaline ions, earth-alkali ions, rare earth ions or metallic ions, e.g. by sodium $Na^+$ ions; however, it would not be departing from the scope of the invention if other cations were present, as described above.

The term "zeolite 3A" is understood here to mean a zeolite of type A, from 20 to 70% (reported as equivalents) of the exchangeable cationic sites of which are occupied by potassium ions; and 30% to 80% are occupied by alkaline ions, earth-alkali ions, rare earth ions or metallic ions, as defined above.

Faujasites constitute a group of mineral entities characterized by their crystallographic topographic structure which are described in particular in the work by Donald W. Breck, "Zeolite Molecular Sieves", published by John Wiley and Sons (1974), pp. 92 et seq.

The "Löwenstein" rule imposes on them an Si/Al molar ratio of greater than or at the very least equal to 1. The practice is to distinguish:

faujasites LSX (acronym for "Low Silica X") or faujasites with a low silica content which are zeolitic entities of type X with an Si/Al atomic ratio of less than or equal to 1.1, preferably between 1.00±0.05 and 1.10±0.05, including the limits, preferably equal to 1.00±0.05 (the values of less than 1 reflect the analytical uncertainties with regard to the measurement of this ratio and the higher values either the same analytical uncertainty or a tolerable departure from purity of the product);

faujasites MSX which are zeolitic entities of type X with an Si/Al atomic ratio of between 1.10±0.05, limits included, and 1.20±0.05, limits included, preferably equal to about 1.15±0.05; and conventional faujasites X with an Si/Al ratio of between 1.20±0.05, limits included, and 1.50±0.05, limits included, preferably equal to about 1.25±0.05; et faujasites Y with an Si/Al ratio>1.5.

The unit cell of zeolite X is a tetrahedron, the vertices of which are occupied by polyhedra of the same type as those present in zeolite A, each being connected to four other polyhedra by virtue of an octahedral substructure formed by a double ring comprising eight oxygen atoms. The centre of each edge is always occupied by an oxygen atom, whereas the silicon and aluminium atoms occupy the different vertices of the polyhedra.

Zeolites X and Y generally are in the sodium form after they have been synthesized: NaX and NaY; zeolite LSX, after synthesis, is in the NaKLSX form.

These zeolites can also be subjected to exchange or modification treatments and the aim is generally to replace the alkali metal (Na, K) cations, for example with protons, alkali metal ions, alkaline earth metal ions, ions of rare earth elements or ions of metals, such as, for example, those mentioned above.

The zeolites of the invention can be provided in the powder form or in the form of agglomerates. The term "agglomeration" is understood to mean the shaping of the zeolite powder using an inorganic and/or organic binder. This shaping of agglomerates can be carried out according to any method known to a person skilled in the art and already widely described in the scientific literature, the patent literature or on the Internet. For example, the agglomerates can be in the form of blocks, beads from a few nanometers to a few millimeters, extrudates, bars, rods or molded components of various sizes and shapes, which can be referred to generically as cores, and the like.

This shaping is carried out by mixing a pasty mixture of zeolite(s), of binder(s) and optionally of one or more additives intended, for example, to facilitate the handling of the paste by modifying the rheology and/or the stickiness. This binder, which is generally inert, is intended to ensure the cohesion of the zeolite crystals with one another.

Use may be made, among inorganic binders, of alumina, montmorillonite (bentonite), attapulgite, sepiolite, zeolitizable clays, such as those chosen from kaolins, kaolinites, nacrites, dickites, halloysites, metakaolins, colloidal clays, for example of Attagel type, or also other natural minerals or zeolites (clinoptilolite, mordenite or chabazite), diatomaceous earths, talc and other inorganic binders known to a person skilled in the art, which can be used alone or as mixtures of two or more of them.

These inorganic binders may, where suitable, be converted in all or in part, into zeolite, according to any procedure known by the skilled in the art as zeolitization.

The organic binders, which can be used alone or in combination with the abovementioned inorganic binders, are understood to include any polymer matrix known per se to a person skilled in the art who is an expert in polymers. It can comprise a thermoplastic and/or thermosetting homopolymer and/or copolymer, for example, and without implied limitation, polyurethane, fluoropolymers, such as PVDF, epoxide resins and others. These polymers can be provided in all forms, for example in the expanded or semiexpanded foam form.

Mention may be made, as examples of polymer matrices, of those described in the international application WO 2010/063975, in which the polymer matrix comprises a polyolefin (for example of polyethylene or polypropylene type, and others), elastomers (such as those of acrylate copolymer type, for example ethylene/butyl acrylate copolymer type), a polyamide, a polyester or also a blend of two or more of these polymers.

The polymer matrix can also comprise, in all or in part, one or more polymers, homo- and/or copolymers, capable of forming a supramolecular assembly. The term "supramolecular assembly" is understood to mean polymers, homo- and/or copolymers, capable of associating with one another by means of hydrogen bonds.

Mention may be made, among "supramolecular" polymers, as non-limiting examples, of semi-crystalline polymers and in particular those formed by supramolecular assembling of compounds resulting from the condensation of a fatty acid and/or of a fatty acid dimer and/or of a fatty acid trimer and of at least one associative amine (capable of forming hydrogen bonds) chosen from 1-(2-aminoethyl) imidazolidin-2-one (UDETA), 1-(2-[(2-aminoethyl)amino] ethyl)-imidazolidone (UTETA), 1-(2-{2-[(2-aminoethyl) amino]ethylamino}ethyl)-imidazolidone (UTEPA), N-(6-aminohexyl)-N'-(6-methyl-4-oxo-1,4-dihydro-pyrimidin-2-yl)urea (UPy), and their mixtures.

In addition to the inorganic and/or organic binders, it is possible to add, to the zeolites, one or more additives commonly employed and known to a person skilled in the art, for example the additives chosen from silica, colloidal silica, cellulose, corn starch or any other type of pore-forming agent.

Generally, the zeolites employed in the present invention can be provided in any form, for example in the form of a zeolitic agglomerate comprising an organic binder, as described in the international application WO 2010/063975 for the removal of water in the double glazing application, or also as described in the U.S. Pat. No. 2,583,812 and U.S. Pat. No. 4,013,566 and the patent applications US 2001/0014707 and EP 1 566 600, in which are disclosed solids based on molecular sieves (zeolites) and on polymers intended for the drying of refrigerants.

Within the meaning of the invention, the zeolitic agglomerate based on organic binder is generally obtained from a compound (blend), followed by shaping, for example by extrusion, molding, extrusion-molding, extrusion-injection molding or any other technique known to a person skilled in the art which makes it possible to obtain an article in the solid form starting from at least one molten polymer matrix.

In one embodiment, the adsorbent material according to the present invention can additionally comprise one or more additives commonly used in compounding techniques. Non-limiting examples of such additives can be chosen from UV stabilizers, pigments, dyes, antioxidants, impact modifiers, phase change materials (PCMs), flame retardants, odorous agents, cellulose and others, alone or as mixtures.

The zeolitic compounds, whether in the agglomerated form or in the powder form (i.e. non-agglomerated form), which can be used in the context of the present invention can optionally be subjected to a treatment by impregnation, for example impregnation in the aqueous phase using alkali metal hydroxide(s) and/or alkaline earth metal hydroxide(s) or by incorporation of this/these hydroxide(s) and/or carbonate(s) and/or salt(s) of alkali metal(s) and/or alkaline earth metal(s), before, after or during the agglomeration stage and/or before, after or during the shaping stage.

This impregnation operation is targeted at impregnating the zeolites or the zeolitic agglomerates with one or more metals, non-metals and/or rare earth elements chosen, for example, from aluminium, scandium, gallium, iron(III), chromium(III), indium, yttrium, lanthanides or more generally rare earth elements, alone or as mixtures, and/or one or more divalent ions chosen from calcium, strontium, zinc, copper, chromium(II), iron(II), manganese, nickel or cobalt ions, alone or as mixtures.

According to another aspect, it should be understood that the treatments targeted at carrying out the cationic exchanges or modifications defined above can be carried out either on the zeolite crystals (powder) or on the preshaped zeolites (agglomerated, impregnated and others) or also before and after shaping the zeolitic adsorbents.

According to a preferred embodiment of the present invention, the zeolitic adsorbents are based on zeolite A or on faujasite zeolite and more preferably still the zeolitic adsorbents are based on zeolite(s) A (3A, 4A or 5A) and more preferably either on zeolite 3A powder or on agglomerates based on zeolite A powder, containing potassium, for example exchanged with potassium, it being possible for the potassium exchange to be carried out either on the starting powder and/or on the final agglomerate.

According to another preferred embodiment, the zeolitic adsorbents which can be used in the context of the present invention are based on zeolites A containing potassium, for example exchanged with potassium, the degree of exchange of which is between 20% and 70% (reported as molar equivalents) of all of the exchangeable cationic sites, preferably between 30% and 70%, more preferably between 40% and 70% and very particularly preferably between 50% and 70%.

When the zeolitic adsorbents are agglomerates of zeolites, the agglomeration binder is preferably attapulgite, colloidal attapulgite, sepiolite, bentonite, kaolin or halloysite, it being possible for these agglomeration binders to be used alone or as mixture(s) with other natural clays or zeolites (clinoptilolite, mordenite or chabazite). Preferably, the agglomeration binder predominantly comprises attapulgite or kaolin and more preferably attapulgite.

Mention may be made, as nonlimiting examples of zeolitic adsorbents which can be used in the context of the present invention, of the adsorbents sold by CECA under the Siliporite® H3Ri, Siliporite® NK10, Siliporite® NK30, Siliporite® SA 1720, Siliporite® NK20 and Siliporite® G5 XP names, those sold by Zeochem under the Purmol® 3ST (3A), Purmol® 4ST (A), Zeochem® Z4-01 and Zeochem® 4A-8BL names, or also those sold by Grace under the Sylosiv® and Cryosiv® names or by UOP under the Molsiv™ 3A, Molsiv™ 4A, Molsiv™ 5A, XH-7™, XH-9™ and XH-11™ names.

The present invention thus relates to the use of at least one zeolitic adsorbent as described above for improving the thermal stability or also reducing the thermal decomposition of oils of any type subjected to variations in temperature.

The term "oil of any type" is understood to mean, as nonlimiting examples, mineral, organic, silicone and other oils and fats used, alone or as mixtures, as automotive lubricants and industrial lubricants, but also used as motor oils, hydraulic fluids, gear oils, brake fluids, oils for compressors, oils for turbines, corrosion inhibitors, cooling lubricants, insulating oils, white oils, greases and the like.

More specifically, the organic oils comprise vegetable oils which are essentially composed of fatty acids and/or esters, particularly of oleic acid. In contrast to paraffin oils and synthetic oils, they have the advantage of being biodegradable, a vegetable oil which is particularly effective in numerous fields of application being castor oil, which can be used pure. Mention may also be made of palm, jojoba and rapeseed oils.

Mineral oils are generally hydrocarbons of various families resulting virtually exclusively from the distillation of oil; various products and additives are generally added to these hydrocarbons for the purpose of conferring thereon better properties as a function of the use anticipated. Mineral oils are classified into a large number of families which correspond to their main uses, for example oils for gasoline engines or diesel engines, hydraulic fluids, machine oils, oils for slideways, for cylinders or for gears, coatings for cables, oils for hydraulic systems and linkages, oils for pneumatic equipment, oils for air or gas compressors, oils for refrigerating compressors, oils for turbines, oils for refrigeration and air conditioning systems, oils for the working of metals by cutting, oils for the working of metals by deformation, oils for the textile industry, and the like.

Mention may be made, among mineral oils, of liquid paraffins (straight-chain molecules) and liquid isoparaffins (branched-chain molecules), naphthenic oils and aromatic oils in general.

Mention may also be made of synthetic oils, such as aliphatic esters, phosphoric esters, silicone and silicate oils, polyphenyl ethers, polyalkylene glycols, polyolefins, including poly-α-olefins, and others.

According to a preferred aspect of the present invention, the zeolitic absorbents are used to ensure the thermal stability of oils of any type used in dynamic or static refrigeration systems.

The oils for refrigeration systems most commonly used today are lubricants which may be mixed with one or more refrigerants, such as, for example, fluorocarbon compounds. These oils (or lubricants) for refrigeration systems are generally and without implied limitation mineral oils or oils based on polyalkylene glycols (PAGs), polyol esters (POEs) and/or polyvinyl ethers (PVEs). For use in the present invention, PAGs and PVEs oils are preferred.

The PAG lubricants are in the form of oxyalkylene homo- or copolymer(s). The preferred PAGs are homopolymers composed of oxypropylene groups and having a viscosity of 10 centiStokes (cSt) to 200 cSt at 40° C., advantageously between 30 cSt and 80 cSt. The hydroxyl groups at the ends of the chains of oxyalkylene homo- and/or copolymer(s) can be more or less replaced by —O—$C_nH_{2n+1}$ groups with n=1 to 10, the group with n=1 being preferred.

The PAGs which are entirely preferred are those having hydroxyl groups at each ending or —O—$C_nH_{2n+1}$ groups, where n is as defined above.

Mention may be made, as oils of PAG type, for example, without implied limitation, of the Zerol™ (Shrieve Chemical Products Inc.), Planetelf PAG (Total), Nippondenso ND8 (Nippon Denso) and Daphne Hermetic PAG (Idemitsu) oils.

The polyol esters (POEs) are obtained by reaction of a polyol (an alcohol comprising at least 2 hydroxyl —OH groups) with a monofunctional or polyfunctional carboxylic acid or with a mixture of monofunctional carboxylic acids. The water formed during this reaction is removed in order to prevent the reverse hydrolysis reaction.

The polyols preferred for the synthesis of the POEs are those having a neopentyl backbone, for example neopentyl glycol, trimethylolpropane, pentaerythritol and dipentaerythritol, pentaerythritol being the most frequently used polyol.

The carboxylic acids which react with the polyols for the formation of the POEs can comprise from 2 to 15 carbon atoms, it being possible for the carbon backbone to be linear or branched. Mention may in particular be made, among these acids, without implied limitation, of n-pentanoic acid, n-hexanoic acid, n-heptanoic acid, n-octanoic acid, 2-ethylhexanoic acid, 2,2-dimethylpentanoic acid, 3,5,5-trimethylhexanoic acid, adipic acid, succinic acid and others, and also the mixtures of two or more of these acids, in all proportions.

Some alcohol functional groups are not esterified; however, their proportion remains low. Thus, the POEs can comprise between 0 and 5 relative molar % of $CH_2$—OH units, with respect to the —$CH_2$—O—(C═O)— units.

The preferred POE lubricants are those having a viscosity of 1 cSt to 1000 cSt at 40° C., preferably of 10 cSt to 200 cSt and advantageously of 30 cSt to 80 cSt.

Mention may be made, as oils of POE type, for example, without implied limitation, of the Mobil EAL Arctic 68 and 32 (Mobil), Planetelf ACD 32 (Total) and Bitzer BSE 32 (Bitzer) oils.

The polyvinyl ether (PVE) oils preferably comprise copolymers exhibiting the following two units 1 and 2:

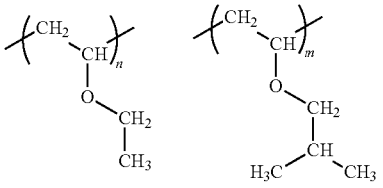

Unit 1 Unit 2 where n and m are integers respectively representing the numbers of units 1 and 2.

The properties of the oil (viscosity, solubility of the refrigerant and miscibility with the refrigerant in particular) can be adjusted by varying the m/n ratio and the m+n sum. The preferred PVE oils are those having from 50% to 95% by weight of units 1.

Mention may be made, as oils of PVE type, for example, without implied limitation, of the Daphne Hermetic Oil FVC 32D and 68D (Idemitsu) oils.

According to another embodiment, the present invention also relates to a refrigeration fluid comprising at least one oil, preferably chosen from among PAGs, POEs et PVEs oils, more preferably from among PAGs and PVEs oils, and at least one zeolite, preferably chosen from among zeolites A, zeolites of the faujasite type, and zeolites Y.

When the abovementioned oils are used in refrigeration systems, they are mixed with at least one refrigerant, in proportions well known to a person skilled in the art, for example so that the oil represents between 10% and 50% inclusive, with respect to the total weight of the oil+refrigerant composition.

The refrigerants which can be mixed with the oils for refrigeration systems are also well known to a person skilled in the art. Mention may be made, among these, of fluorinated compounds, in particular hydrofluoroolefins (HFOs) and hydrofluorocarbons (HFCs). Mention may more particularly be made of tetrafluoroethanes and tetrafluoropropenes, such as, without implied limitation, 1,1,1,2-tetrafluoroethane (R-134a) and 2,3,3,3-tetrafluoropropene (HFO-1234yf), and the mixtures of two or more refrigerants in all proportions. The refrigerant can also comprise one or more additives commonly used in the field, such as odorous compounds.

The invention thus relates, according to a preferred embodiment, to the use of at least one zeolitic absorbent, preferably based on zeolite(s) A, for the stabilization of oils and preferably of oils for refrigeration systems, that is to say of compositions comprising at least one oil and at least one refrigerant, and preferably of compositions comprising at least one oil of PAG, POE and/or PVE type and at least one refrigerant chosen from R-134a and HFO-1234yf.

The use of the present invention is entirely appropriate for improving the thermal stability of refrigerating systems comprising PAG and R-134a, PAG and HFO-1234yf, POE and R-134a, POE and HFO-1234yf, PVE and R-134a, and PVE and HFO-1234yf, preferably PAG and R-134a, PAG and HFO-1234yf, PVE and R-134a and PVE and HFO-1234yf.

In the context of the present invention, the thermal stability of an oil is evaluated by measuring the Total Acid Number (TAN) of the composition comprising said oil. Specifically, oils, which are subjected to more or less large variations in temperature, change over time to in the end become unsuitable for the use for which they are intended.

This change in the quality of the oils can be measured by numerous factors and in particular by the total acid number TAN. This is because it is known that the aging of oils is mainly due to the presence of acidic entities in the oils, which tend to increase over time. In the majority of cases, the total acid number slowly increases with the operating time and can be a good indicator for carrying out the replacement of the lubricant.

The amount of acidic entities in the oils can be measured by the total acid number TAN, which corresponds to the number of milligrams of potassium hydroxide necessary to neutralize the acidic entities present in one gram of oil.

The Applicant Company has discovered, surprisingly, that bringing at least one zeolitic adsorbent as described above into contact with an oil subjected to more or less large variations in temperature makes it possible to limit the increase in the TAN of the oil over time, indeed even to stabilize the TAN of said oil, this having the effect of appreciably slowing down the aging of said oil and consequently of lengthening the lifetime thereof and of lengthening the periods between which the oils have to be regenerated or replaced, in full or in part.

Specifically, oils (lubricants) have many functions and mention may be made, inter alia, of the reduction in friction and resistance to motion in machines, in order to improve their efficiency and to save energy, to protect the lubricated parts from the various forms of corrosion and wear, thus to contribute to their longevity, to remove the heat produced in engines or during machining, to promote the thermal equilibrium of the machines, to improve the leaktightness with respect to gases, liquids or dust, to remove impurities and wear debris, to transmit energy or heat, to ensure electrical insulation or to improve the surface condition of the machined parts, to mention only some of them.

Thus, the use according to the present invention exhibits numerous advantages, among which may be mentioned, inter alia, the limitation on the deterioration in the oils, the improvement in the lubricating properties over time, the limitation on the wear of the systems using these oils, and a degree of advantage with regard to protecting the environment, by reducing the amounts of discharges of waste oils, their operating lives being extended.

The method of bringing at least one zeolitic adsorbent defined above into contact with an oil can be of any type known per se, that is to say any method of bringing a solid into contact with a liquid, whether statically or dynamically.

Thus, the zeolitic adsorbent can be simply placed in the vessel, tank or sump comprising the oil, with or without stirring. In an alternative form, the oil can be forced through the zeolitic adsorbent(s), for example placed in a cartridge or agglomerated in the form of a core of appropriate size and dimensions, a more or less high pressure being or not being applied to the oil.

The amount of zeolitic adsorbent(s) coming into contact with the oils can vary within wide limits, in particular according to the quality and the amount of oil to be treated and the magnitude and the frequency of the variations in temperature. A person skilled in the art can easily adjust the amount of zeolitic adsorbent(s) to be used according to the operating conditions of the devices and systems employing the oils.

The zeolitic adsorbents described above for stabilizing or at the very least slowing down the aging of the oils and thus increasing their operating lifetime can thus be used in a great many fields and a great many applications, in particular applications where the oils are subjected to more or less frequent and more or less large variations in temperature.

Mention may be made, as nonlimiting examples of applications in which the use according to the present invention can be implemented, of:

- refrigeration, in particular domestic or commercial refrigeration, cold rooms, food industry, processing industry, refrigerated transport (trucks, ships);
- air conditioning: motor vehicle air conditioning or domestic, commercial or industrial air conditioning; for the latter applications, the appliances used are either chillers or direct expansion appliances;
- heat pumps, in particular medium- and high-temperature heat pumps;
- electric transformers;
- metal cutting and milling instruments;
- and others.

The present invention is now illustrated by means of the examples which follow and which do not in any way limit the field of the invention, the scope of protection of which is conferred by the appended claims.

EXAMPLE 1

Thermal Stability Tests on an Oil without Refrigerant

The thermal stability tests are carried out on oil compositions for refrigerating systems, without refrigerant, according to the standard ASHRAE 97-2007: "Sealed glass tube method to test the chemical stability of materials for use within refrigerant systems".

The test conditions are as follows:

weight of lubricant: 5 g
weight of zeolitic adsorbent: 40 to 1000 mg
temperature: 200° C.
duration: 14 days The zeolitic adsorbent and the lubricant are introduced into a glass tube with a volume of 42.2 ml. The tube is subsequently placed under vacuum, then sealed in order to hermetically close it and placed in an oven at 200° C. for 14 days.

The oil used in this test is the PAG ND8 oil sold by Nippon Denso. The adsorbents used originate from CECA. The total acid number of the oil is measured at t=2 hours (t=0 for the control) and then at t=14 days, by quantitative determination with 0.01N methanolic potassium hydroxide solution. The results are shown in the following table 1:

TABLE 1

| Adsorbent | Type of adsorbent | Amount of adsorbent (mg) | TAN (mg KOH/g) t = 2 hours | TAN (mg KOH/g) t = 14 days |
|---|---|---|---|---|
| None | — | — | 0.1 | 1.6 |
| Siliporite ® NK30 AP Powder | 3A | 200 | <0.1 | 0.4 |
| Siliporite ® NK30 AP Powder overexchanged | 3A | 200 | <0.1 | 0.4 |

These results show that the zeolitic adsorbents make it possible to considerably slow down the rate of increase in the total acid number (TAN) of an oil.

EXAMPLE 2

Thermal Stability Tests on an Oil with Refrigerant

The thermal stability tests are carried out on oil compositions for refrigerating systems, that is to say comprising a refrigerant, according to the standard ASHRAE 97-2007: "Sealed glass tube method to test the chemical stability of materials for use within refrigerant systems".

The test conditions are as follows:

weight of refrigerant: 2.2 g
weight of lubricant: 5 g
weight of zeolitic adsorbent: 40 to 1000 mg
temperature: 200° C.
duration: 14 days The zeolitic adsorbent and the lubricant are introduced into a glass tube with a volume of 42.2 ml. The tube is subsequently placed under vacuum and then the refrigerant is added. The tube is then sealed in order to hermetically close it and is placed in an oven at 200° C. for 14 days.

Various analyses are carried out at the end of the test:

The gas phase is recovered in order to be analyzed by gas chromatography: the main impurities are identified by GC/MS (gas chromatography/mass spectrometry). Impurities coming from the refrigerant and those coming from the lubricant can thus be grouped together.

The lubricant is analyzed: color (by spectrocolorimetry, Labomat Dr Lange Lico220 Model MLG131), water content (by Karl Fischer coulometric titration, Mettler DL37) and total acid number (by quantitative determination with 0.01N methanolic potassium hydroxide solution).

The lubricants used in the tests are commercial PAG and POE oils: PAG ND8 and POE Ze-GLES RB68, sold respectively by Nippon Denso and Nippon Oil.

The refrigerants used for these tests are either HFO-1234yf or R-134a.

The results shown in the following table 2 are obtained with HFO-1234yf and, as lubricant, commercial PAG oil PAG ND8 and various zeolitic adsorbents supplied by CECA S.A.

TABLE 2

| Adsorbent | Type of adsorbent | Amount of adsorbent (mg) | TAN (mg KOH/g) |
|---|---|---|---|
| None | — | — | 4.7 |
| Siliporite ® NK30 AP Powder | 3A | 200 | 1.7 |
| Siliporite ® NK30 AP Powder | 3A | 1000 | 2.6 |
| Siliporite ® NK30 AP Powder overexchanged | 3A | 200 | 1.5 |
| Siliporite ® NK30 AP Powder overexchanged | 3A | 1000 | 2.5 |
| Siliporite ® NK30 Beads (Static) | 3A | 1000 | 1.6 |
| Siliporite ® NK10 AP Powder | 4A | 1000 | 2.7 |
| Siliporite ® NK20 | 5A | 1000 | 2.4 |
| Siliporite ® G5 XP Powder | 10A | 1000 | 2.7 |

These first results show that the presence of zeolitic adsorbents in oils makes it possible to considerably reduce the TAN of said oils.

These results are confirmed, in the following table 3, with the tests carried out with compositions comprising R-134a and, as lubricant, PAG ND8 oil and various zeolitic adsorbents.

TABLE 3

| Adsorbent | None | Siliporite ® NK30 AP Powder | Siliporite ® NK30 AP Powder overexchanged |
|---|---|---|---|
| Type of adsorbent | — | 3A | 3A |
| Amount of adsorbent (mg) | — | 200 | 200 |
| TAN (mg KOH/g) | 2.9 | 0.5 | 0.4 |

It is thus observed that, in the presence of zeolitic adsorbent, the total acid number of an oil at the end of the test is greatly reduced, generally divided by 2 or 3. For the tests in the presence of HFO1234yf, it changes from 4.7 mg KOH/g without adsorbent to values of between 1.5 and 2.7 mg KOH/g with adsorbent. For the tests with R-134a, it changes from 2.9 mg KOH/g without adsorbent to 0.5 mg KOH/g with adsorbent.

In addition, whatever the type of adsorbent (3, 4, 5 or 10 Å), the results are identical: the total acid number is divided by a factor of approximately 2 in the tests carried out in the presence of 1 g of adsorbent.

What is claimed is:

1. A method for improving the thermal stability of a composition, said composition containing an oil, subjected to variations in temperature, which comprises adding at least one zeolitic adsorbent, in the form of a powder formed of zeolite(s) or of agglomerate(s) formed of zeolite(s) to the composition, wherein the at least one zeolitic adsorbent is free of metal impregnation and the at least one zeolitic adsorbent is based on zeolite(s) A exchanged with potassium, the degree of exchange of which is between 50% and 70% (reported as molar equivalents) of all of the exchangeable cationic sites, wherein the at least one zeolitic adsorbent is present in an effective amount to limit or reduce the total acid number of the oil and the effective amount is about 40 mg to about 1000 mg per 5 g of oil.

2. The method as claimed in claim 1, wherein the at least one zeolitic adsorbent is chosen from a mixture of zeolite A type and one or both of zeolites of faujasite type and zeolites Y.

3. The method as claimed in claim 2, wherein the at least one zeolitic adsorbent is chosen from a mixture of zeolites of zeolite A type and zeolites of faujasite type.

4. The method as claimed in claim 1, wherein the oil is chosen from mineral, organic or silicone oils and fats used, alone or as mixtures, as automotive lubricants and industrial lubricants but also used as motor oils, hydraulic fluids, gear oils, brake fluids, oils for compressors, oils for turbines, oils for refrigeration and air conditioning systems, corrosion inhibitors, cooling lubricants, insulating oils, white oils, greases and the like.

5. The method as claimed in claim 1, wherein the oil is an oil used in dynamic or static refrigeration systems.

6. The method as claimed in claim 1, wherein the oil is an oil based on polyalkylene glycols (PAGs), on polyol esters (POEs) and/or on polyvinyl ethers (PVEs).

7. The method as claimed in claim 1, wherein the oil is an oil used in refrigeration systems and comprises at least one refrigerant.

8. The method as claimed in claim 1, wherein the oil is an oil used in refrigeration systems and comprises at least one refrigerant selected from the group consisting of hydrofluoroolefins (HFOs), hydrofluorocarbons (HFCs), and mixtures thereof in all proportions.

9. The method as claimed in claim 1, wherein the oil is a mixture of an oil and of a refrigerant, said mixture being chosen from PAG oil and 1,1,1,2-tetrafluoroethane, PAG oil and 2,3,3,3-tetrafluoropropene, POE oil and 1,1,1,2-tetrafluoroethane, POE oil and 2,3,3,3-tetrafluoropropene, PVE oil and 1,1,1,2-tetrafluoroethane, and PVE oil and 2,3,3,3-tetrafluoropropene.

10. The method as claimed in claim 1, wherein the oil is employed in refrigeration systems, motor vehicle or domestic air conditioning systems, heat pumps, electric transformers or metal cutting and milling instruments.

11. A refrigerating fluid comprising at least one oil selected from the group consisting of PAGs, POEs and PVEs, and at least one zeolite, wherein the at least one zeolite is free of metal impregnation and the at least one zeolite is based on zeolite(s) A exchanged with potassium, the degree of exchange of which is between 50% and 70% (reported as molar equivalents) of all of the exchangeable cationic sites, wherein the at least one zeolite is present in an effective amount to limit or reduce the total acid number of the oil and the effective amount is about 40 mg to about 1000 mg per 5 g of oil.

12. The method of claim 1, wherein the at least one zeolitic adsorbent is selected from the group consisting of zeolite 3A powder and agglomerates based on zeolite A powder, wherein the potassium exchange is carried out on the powder, the agglomerate, or both.

13. The method of claim 8, wherein the refrigerant is selected from the group consisting of tetrafluoroethanes, tetrafluoropropenes, and mixtures thereof in all proportions.

14. The method of claim 13, wherein the refrigerant is selected from the group consisting of 1,1,1,2-tetrafluoroethane, 2,3,3,3-tetrafluoropropene, and mixtures thereof in all proportions.

15. The refrigerating fluid of claim 11, wherein the oil is selected from the group consisting of PAGs and PVEs.

16. The refrigerating fluid of claim 11, wherein the zeolite is selected from a mixture of zeolites A and one or both of zeolites of the faujasite type and zeolites Y.

17. The method of claim 1, wherein the at least one zeolitic adsorbent is based on zeolite(s) 3A.

18. The method of claim 1, wherein the at least one zeolitic adsorbent is based on zeolite(s) 4A.

19. The method of claim 1, wherein the at least one zeolitic adsorbent is based on zeolite(s) 5A.

20. The method of claim 1, wherein the at least one zeolitic adsorbent is added in the form of a powder formed of zeolite(s).

21. The method of claim 1, wherein the at least one zeolitic adsorbent is added in the form of agglomerate(s) formed of zeolite(s).

22. The method of claim 1, wherein the at least one zeolitic adsorbent is present in the effective amount to limit or reduce the total acid number ("TAN 14 day") of the oil such that the total acid number is maintained at or below 2.7 mg KOH/g.

23. The refrigerating fluid of claim 11, wherein the at least one zeolite is present in the effective amount to limit or reduce the total acid number ("TAN-14 day") of the oil such that the total acid number is maintained at or below 2.7 mg KOH/g.

24. A method for improving the thermal stability of a composition, said composition containing an oil, subjected to variations in temperature, which comprises adding at least one zeolitic adsorbent, in the form of a powder formed of zeolite(s) or of agglomerate(s) formed of zeolite(s) to the composition, wherein the at least one zeolitic adsorbent is free of metal impregnation and the at least one zeolitic adsorbent is based on zeolite(s) A exchanged with potassium, the degree of exchange of which is between 50% and 70% (reported as molar equivalents) of all of the exchangeable cationic sites, wherein the at least one zeolitic adsorbent is present in an effective amount to limit or reduce the total acid number of the oil such that the total acid number ("TAN-14 day") is maintained at or below 2.7 mg KOH/g.

25. A refrigerating fluid comprising at least one oil selected from the group consisting of PAGs, POEs and PVEs, and at least one zeolite, wherein the at least one zeolite is free of metal impregnation and the at least one zeolite is based on zeolite(s) A exchanged with potassium, the degree of exchange of which is between 50% and 70% (reported as molar equivalents) of all of the exchangeable cationic sites, and at least one other alkali or alkaline earth metal, the degree of exchange of which is between 30% and 50% (reported as molar equivalents) of all of the exchangeable cationic sites.

26. The refrigerating fluid of claim 25, wherein the at least one other alkali or alkaline earth metal is sodium.

27. The refrigerating fluid of claim 25, wherein the at least one zeolite is present in an effective amount to limit or reduce the total acid number of the oil such that the total acid number ("TAN-14 day") is maintained at or below 2.7 mg KOH/g.

28. The refrigerating fluid of claim 25, wherein the at least one zeolite is present in an effective amount to limit or reduce the total acid number of the oil and the effective amount is about 40 mg to about 1000 mg per 5 g of oil.

* * * * *